US010888130B1

(12) United States Patent
Naos

(10) Patent No.: US 10,888,130 B1
(45) Date of Patent: Jan. 12, 2021

(54) FACE SHIELD FOR PERSONAL PROTECTION

(71) Applicant: Pegasos One, LLC, Miami, FL (US)

(72) Inventor: Spiro Naos, Miami, FL (US)

(73) Assignee: Pegasos One, LLC, Miami, FL (US)

( * ) Notice: Subject to any disclaimer, the term of this patent is extended or adjusted under 35 U.S.C. 154(b) by 0 days.

(21) Appl. No.: 16/932,450

(22) Filed: Jul. 17, 2020

(51) Int. Cl.
*A41D 13/11* (2006.01)

(52) U.S. Cl.
CPC ..... *A41D 13/1107* (2013.01); *A41D 13/1161* (2013.01)

(58) Field of Classification Search
CPC ..... A41D 13/1107; A41D 13/1161; A41D 13/1184; A41D 13/1146; A41D 13/1138; A61F 9/026; A61F 9/045; G02C 7/16; G02C 11/11
USPC ..... D29/108
See application file for complete search history.

(56) References Cited

U.S. PATENT DOCUMENTS 715,052 A * 12/1902 Goodwin ..... A41D 13/1161 128/206.13
1,199,529 A * 9/1916 Collman ..... A41D 13/1107 128/863
1,463,390 A * 7/1923 Fernandes ..... A41D 13/1146 128/863
1,491,674 A * 4/1924 Coletti ..... A41D 13/1146 128/206.13
2,281,181 A * 4/1942 Clarke ..... A41D 13/1161 128/204.15
2,447,450 A * 8/1948 Williams ..... A41D 13/1161 128/206.13
2,498,668 A * 2/1950 Fitzsimmons ..... A41D 13/11 128/863
2,952,853 A * 9/1960 Benzel ..... A41D 13/11 2/429
3,038,470 A * 6/1962 Campbell ..... A41D 13/1161 128/206.16
3,196,458 A * 7/1965 Keith ..... A63B 71/10 2/9
3,298,031 A * 1/1967 Morgan ..... A61F 9/029 2/9
3,308,816 A * 3/1967 Franklin ..... A41D 13/1146 128/207.11
3,878,563 A * 4/1975 Pulju ..... A41D 13/1161 2/9
3,924,388 A * 12/1975 Morrison ..... A61F 9/026 54/80.1
3,991,753 A * 11/1976 Viesca y Viesca ..... A41D 13/1184 128/201.12
D267,128 S * 12/1982 Pearce ..... D16/339
(Continued)

*Primary Examiner* — Heather Mangine
(74) *Attorney, Agent, or Firm* — Mark Terry

(57) ABSTRACT

An item of personal protective equipment including a face shield. The face shield includes a transparent planar plastic element that extends from below the eyes to the chin configured to have a portion shaped and sized to match the contours of a person's face. The face shield further includes a soft plastic portion that comes into contact with person's face below the eyes, and a retention mechanism, such as an elastic band or temples, affixed to the face shield allowing the face shield to be retained on the face of the person in a manner that prevents exposure to viruses/diseases while avoiding obstruction of the person's eyes.

20 Claims, 7 Drawing Sheets

(56) References Cited

U.S. PATENT DOCUMENTS 4,643,182 A * 2/1987 Klein ..... A41D 13/11 128/201.25
4,779,291 A * 10/1988 Russell ..... A61F 9/026 2/439
4,821,340 A * 4/1989 Johnson ..... A41D 13/11 128/863
4,843,643 A * 7/1989 Parissenti ..... A41D 13/11 2/13
4,944,039 A * 7/1990 Dietrich ..... A41D 13/11 2/13
4,944,312 A * 7/1990 Smith ..... A41D 13/1161 128/207.11
5,165,395 A * 11/1992 Ricci ..... A41D 13/1146 128/202.22
5,214,804 A * 6/1993 Carey ..... A41D 13/1161 2/171
5,233,978 A * 8/1993 Callaway ..... A61M 16/06 128/205.25
5,303,423 A * 4/1994 Gazzara ..... A61F 9/02 128/857
5,419,318 A * 5/1995 Tayebi ..... A41D 13/1146 128/205.27
5,558,089 A * 9/1996 Castiglione ..... A41D 13/1146 128/206.24
5,561,863 A * 10/1996 Carlson, II ..... A41D 13/1115 128/206.19
5,570,705 A * 11/1996 Burke ..... A41D 13/1161 128/869
5,619,287 A * 4/1997 Tseng ..... A61F 9/02 2/10
5,666,664 A * 9/1997 Hamilton ..... G02C 9/04 2/13
5,727,544 A * 3/1998 Miura ..... A41D 13/11 128/201.13
5,956,119 A * 9/1999 Gibbs ..... G02C 11/00 2/9
5,969,786 A * 10/1999 Marcum ..... A61F 9/02 351/156
5,983,390 A * 11/1999 Desy ..... A41D 13/1161 128/858
5,987,653 A * 11/1999 Cyr ..... A61F 9/025 16/228
6,094,751 A * 8/2000 Parks ..... A61F 9/029 2/431
6,282,727 B1 * 9/2001 Lindahl ..... A61F 9/025 2/428
7,836,887 B1 * 11/2010 Kling ..... A41D 13/1161 128/206.16
8,978,655 B2 * 3/2015 Duke ..... A62B 23/025 128/206.12
D781,503 S * 3/2017 Rose ..... D29/108
2001/0015205 A1 * 8/2001 Bostock ..... A41D 13/1161 128/206.19
2004/0211426 A1 * 10/2004 Lai ..... A41D 13/1184 128/206.21
2006/0230485 A1 * 10/2006 Lee ..... A41D 13/1176 2/15
2007/0024806 A1 * 2/2007 Blanshay ..... A61F 9/026 351/62
2008/0143953 A1 * 6/2008 Welchel ..... A41D 13/1184 351/62
2008/0271739 A1 * 11/2008 Facer ..... A41D 13/11 128/206.19
2009/0126064 A1 * 5/2009 Reaux ..... A41D 13/1161 2/15
2010/0225879 A1 * 9/2010 Pulito ..... G02C 5/122 351/137
2010/0258130 A1 * 10/2010 Wu ..... A41D 13/1107 128/206.13
2011/0197898 A1 * 8/2011 Chiu ..... A41D 13/1184 128/859
2012/0047614 A1 * 3/2012 Choi ..... A41D 13/1184 2/9
2012/0260389 A1 * 10/2012 Gosine ..... A41D 13/1184 2/9
2012/0291173 A1 * 11/2012 Gleason ..... A41D 13/1184 2/10
2013/0019879 A1 * 1/2013 Hsu ..... A41D 13/1161 128/863
2013/0255698 A1 * 10/2013 Ryou ..... A41D 13/1161 128/863
2014/0059747 A1 * 3/2014 Belbey ..... G02C 5/12 2/431
2014/0060550 A1 * 3/2014 Lai ..... A41D 13/1161 128/863
2015/0020815 A1 * 1/2015 Gabriel ..... A41D 13/1161 128/863
2015/0173933 A1 * 6/2015 Castillo ..... A61F 9/029 606/204.45
2015/0245675 A1 * 9/2015 Chinquee ..... A61F 9/029 2/424
2016/0001101 A1 * 1/2016 Sabolis ..... A62B 9/02 128/863
2016/0058081 A1 * 3/2016 Lee ..... A41D 13/1107 128/863
2016/0129287 A1 * 5/2016 Danford ..... A62B 23/025 128/863
2017/0239089 A1 * 8/2017 Quinn ..... A61F 9/025
2018/0228652 A1 * 8/2018 Ohura ..... A61F 9/025
2018/0264294 A1 * 9/2018 Hancock ..... A41D 13/1138
2018/0368493 A1 * 12/2018 Houde ..... A41D 13/1107
2019/0000163 A1 * 1/2019 Houde ..... A41D 13/1123
2019/0009114 A1 * 1/2019 Han ..... A41D 1/002
2019/0217032 A1 * 7/2019 Shariff ..... A41D 13/1107
2019/0274884 A1 * 9/2019 Skov ..... A61F 9/029
2020/0100657 A1 * 4/2020 Lee ..... A61B 1/233

* cited by examiner

FACE SHIELD FOR PERSONAL PROTECTION

CROSS-REFERENCE TO RELATED APPLICATIONS

Not applicable.

STATEMENT REGARDING FEDERALLY SPONSORED RESEARCH OR DEVELOPMENT

Not applicable.

INCORPORATION BY REFERENCE OF MATERIAL SUBMITTED ON A COMPACT DISC

Not applicable.

TECHNICAL FIELD

The claimed embodiments relate to personal protective equipment, and more specifically, to the field of face shields.

BACKGROUND

Personal protective equipment (PPE) is equipment worn to minimize exposure to hazards. Historically, PPE was commonly associated with hazards that were generally inherent to workplace environments and associated industries with a high likelihood of injury or illness, such as chemical, radiological, physical, electrical, mechanical, and other applicable environments. However due to the rise of contagious viruses/diseases and the rampant spread of associated germs, PPE has recently become common to wear in all environments configured to occupy more than one person at a time. For example, it is common to see ordinary individuals wearing PPE, such as respiratory masks, during everyday tasks like grocery shopping.

Face shields being used as PPE in public places, such as airports, has become common in which individuals wear the face shields supported by a user's head via a headband, visor, or helmet, with the face shield guarding the user's face from exposure to contagious germs and/or viruses/diseases when in operation. However, these face shield configurations are simply a bulky planar surface attached to the aforementioned shield supports that are not configured to be worn for extended periods of time in a comfortable manner. Thus, situations where PPE is required to be worn for long periods of time, such as plane flights, become extremely uncomfortable for the user. An additional drawback to these configurations are that they cover both the nose and the eyes of the wearer resulting in frequent fogging of the face shield effecting the user's ability to see through the face shield, especially in situations where the user is wearing a mask under the face shield.

Furthermore, the aforementioned face shield configurations do not account for adaptability to the contours and other facial features of the user preventing a sleek and fitted while simultaneously comfortable retention of the face shield to the user's face.

Therefore, there exists a need for improvements over the prior art and more particularly for a face shield that includes a sleek and fitted donning to the user's face that accounts for contours of the user's face without obstructing the view of the user.

SUMMARY

This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, an item of personal protective equipment is disclosed. The item of personal protective equipment comprises a face shield comprising: a planar plastic element that is transparent, wherein the planar plastic element is curved to fit a person's face, wherein a top edge of the planar plastic element is shaped to match contours of the person's face below the person's eyes, and wherein the bottom of edge the planar plastic element extends at least to the person's chin; a portion of soft plastic coupled to the top edge of the planar plastic element such that the portion of soft plastic contacts the person's face below the person's eyes; and an elastic band coupled to a left side and a right side of the planar plastic element, wherein the elastic band is configured to extend around the person's head and secure the face shield to the person's face.

In another embodiment, the item of personal protective equipment comprises a face shield comprising: a planar plastic element that is transparent, wherein the planar plastic element extends from below the person's eyes to at least to the person's chin, wherein a top edge of the planar plastic element is shaped to match contours of the person's face below the person's eyes; a portion of soft plastic coupled to the top edge of the planar plastic element such that the portion of soft plastic contacts the person's face below the person's eyes; and an elastic band coupled to a left side and a right side of the planar plastic element, wherein the elastic band is configured to extend around the person's head and secure the face shield to the person's face.

In yet another embodiment, the item of personal protective equipment comprises a face shield comprising: a planar plastic element that is transparent, wherein the planar plastic element extends from below the person's eyes to at least to the person's chin, wherein a top edge of the planar plastic element is shaped to match contours of the person's face below the person's eyes; a portion of soft plastic coupled to the top edge of the planar plastic element such that the portion of soft plastic contacts the person's face below the person's eyes; and a first temple coupled to a left side of the planar plastic element and a second temple coupled to a right side of the planar plastic element, wherein the first and second temples are configured to secure the face shield to the person's face.

To the accomplishment of the above and related objects, claimed embodiments may be embodied in the form illustrated in the accompanying drawings, attention being called to the fact, however, that the drawings are illustrative only, and that changes may be made in the specific construction illustrated and described within the scope of the appended claims. The foregoing and other features and advantages of the claimed embodiments will be apparent from the following more particular description of the preferred embodiments, as illustrated in the accompanying drawings.

BRIEF DESCRIPTION OF THE DRAWINGS

The accompanying drawings, which are incorporated in and constitute part of this specification, illustrate embodiments of the invention and together with the description, serve to explain the principles of the disclosed embodiments. The embodiments illustrated herein are presently preferred, it being understood, however, that the invention is not limited to the precise arrangements and instrumentalities shown, wherein.

DETAILED DESCRIPTION

Figure 1:
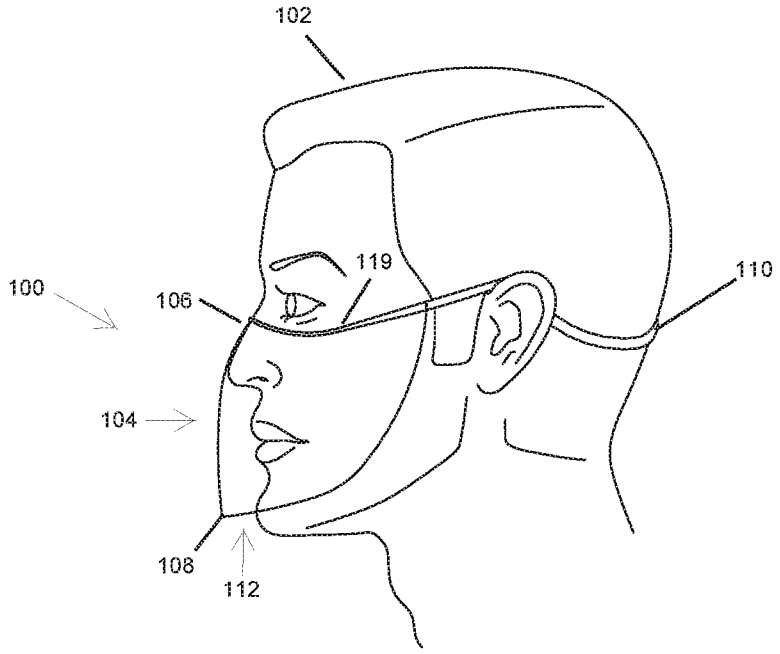
FIG. 1 is a left side view of an item for personal protective equipment comprising a face shield donned by a user, according to a first example embodiment.
Figure 2:
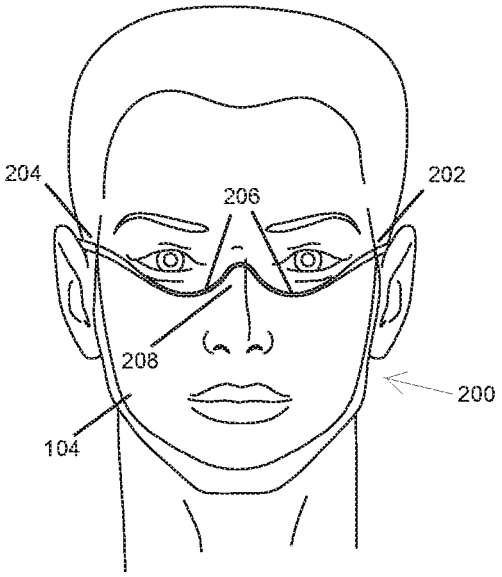
FIG. 2 is a first front view of the item for personal protective equipment comprising a face shield donned by the user according to a second example embodiment.
Figure 3:
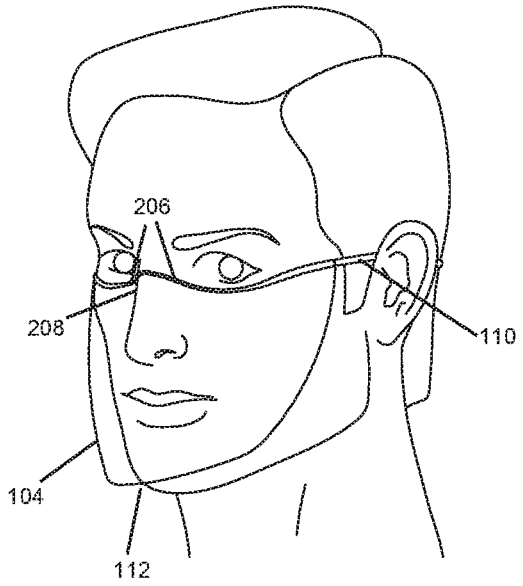
FIG. 3 is a first front perspective view of the item for personal protective equipment comprising a face shield donned by the user according to the second example embodiment.
Figure 4:
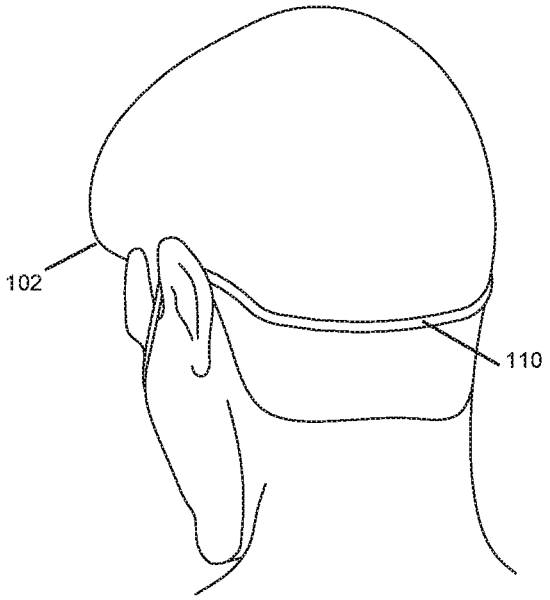
FIG. 4 is a first rear perspective view of the item for personal protective equipment comprising a face shield donned by the user according to the second example embodiment.
Figure 5:
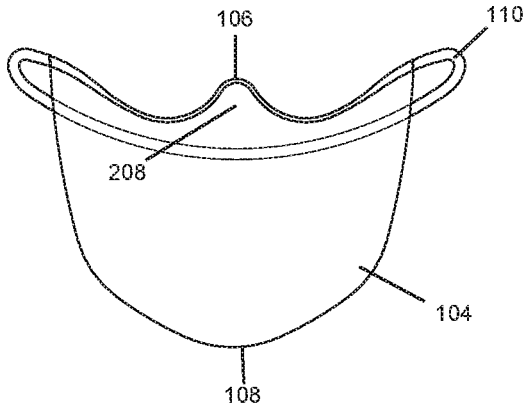
FIG. 5 is a front view of the item for personal protective equipment comprising a face shield according to the second example embodiment.
Figure 6:
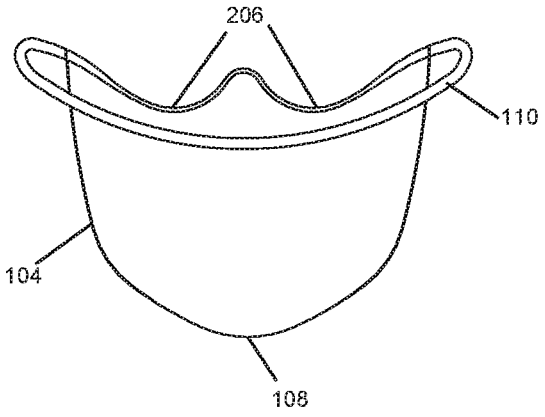
FIG. 6 is a rear view of the item for personal protective equipment comprising a face shield according to the second example embodiment.

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions, or modifications may be made to the elements illustrated in the drawings, and the methods described herein may be modified by substituting reordering or adding additional stages or components to the disclosed methods and devices. Accordingly, the following detailed description does not limit the disclosed embodiments. Instead, the proper scope of the disclosed embodiments is defined by the appended claims.

The disclosed embodiments improve upon the problems with the prior art by providing an item of personal protective equipment comprising a face shield that simultaneously avoids covering the eyes while maintaining a sleek and fitted retention to the user's face preventing obstruction of the user's view due to issues, such as fogging, that are common to face shields that cover the eyes. The present embodiment also improves over the prior art by proving a face shield composed of soft plastic material configured to match the contours of the user's face not only allowing a comfortable fitting of the face shield to the user's face, but also enabling the face shield to be worn for extended periods of time. The present embodiment also improves over the prior art by proving a face shield that is worn separately and distinctly from goggles, glasses, or other eyewear such that one item of PPE does not obstruct or inhibit the use of the other item of PPE.

Referring now to FIG. 1, an item of personal protective equipment comprising a face shield 100 donned by a user 102 is presented from the left side according to a first example embodiment. In one embodiment, face shield 100 comprises a planar plastic element 104 comprising a top edge 106, a bottom edge 108, and an elastic band 110 configured to assist with the retention of face shield 100 to the face of user 102 in a manner in which an opening (or gap) 112 is formed below the lips of user 102. In one embodiment, planar plastic element 104 extends from top edge 106 configured to be aligned at or near the dorsum of user 102 all the way to bottom edge 108 configured to be aligned at or near the chin of user 102. It is to be understood that many variations of face shield 100 are possible in which face shield 100 may further comprise filters, slits, openings, and other components allocated along planar plastic element 104 that are configured to contribute to the breathing of user 102 while donning face shield 100.

In one embodiment, planar plastic element 104 is transparent and composed of polycarbonate or any other applicable thermoplastic polymers. Planar plastic element 104 is configured to be worked, molded, and thermoformed in a variety of colors and hues. Planar plastic element 104 may further be configured to include a variety of films, such as a UV protective film, or a polarizing film. In one embodiment, planar plastic element 104 is composed of polypropylene, acrylic, reusable plastic, non-reusable plastic, or any combination thereof that allows face shield 100 to maintain its lightweight and sleek configuration without falling subject to fogging caused by the nose and/or lips of user 102. In one embodiment, planar plastic element 104 is preferably fabricated as a single, unitary member configured to donned by user 102 in a manner where top edge 106 is configured to be in direct contact with the nose of user 102. In one embodiment, planar plastic element 104 supports disposing of various plastic materials that are allocated based on applicable location where planar plastic element 104 comes into contact with the face of user 102. For example, top edge 106 may comprise or is configured to have affixed thereto a portion 119 of soft plastic or rubber that contacts the face of user 102 below the eyes while the remaining portions of planar plastic element 104 not configured to be associated with the contours of the face of user 102 may be composed of a more impenetrable material so as to increase the efficiency of face shield 100 relating to prevention of viruses/diseases and applicable germs coming into contact with the nose and mouth of user 102. However, the allocation of various types of plastic disposed along the planar plastic element 104 will not change the overall lightweight and comfortable-fitting nature of face shield 100.

In one embodiment, top edge 106 is configured to be associated with a nose bridge 113 (see FIG. 10) configured to be allocated along a middle portion of face shield 100 allowing top edge 106 to come into direct contact with at least the nose and the area under the eyes of user 102. In one embodiment, nose bridge 113 comprises one or more seal forming portions and a cushion component in order to provide a more comfortable fitting based on a more stable foundation rooted in the nose area of user 102; however, in some embodiments the aforementioned components may not be necessary in order for top edge 106 to match the contours of the face of user 102. It is to be understood that the seal forming portions may be arranged in a manner in which they comfortably fit nose bridge 113 to the exterior surface of the nose of user 102, and nose bridge 113 may come in varying shapes and sizes in order to accommodate users that have different depths relating to contours on the face. In one embodiment, the allocation of nose bridge 113 to the middle portion of top edge 106 allows the portion 119 of soft plastic to contact the face of user 102 right below the eyes. In one embodiment, the nose bridge 113 comprises a roughly U-shaped element that rests on the crown of the nose so as to provide a comfortable interface between the device 100 and the user's nose.

In one embodiment, elastic band 110 is integrated or interlaced into the upmost point of top edge 106 directly above nose bridge 113. Preferably elastic band 110 is permanently affixed to at least a portion of planar plastic element 104, in which elastic band 110 is allocated along the upmost point of top edge 106 at varying volumes in order to simultaneously provide to comfort to user 102 and a supporting retention base. For example, the figures vividly depict elastic band 110 in a manner in which minimal or significantly lower amounts of elastic are allocated along the upmost point of top edge 106 compared to the remaining portions of face shield 100 that are not in contact with the contours of the face of user 102. In one embodiment, the volume of elastic material for elastic band 110 is at its smallest amount directly above the nose at the upmost point of top edge 106 and incrementally becomes increasingly voluminous in both directions from the upmost point of top edge 106 resulting in the volume of elastic becoming the most substantial once elastic band 110 comes into contact with the outer ears of user 102. It is to be understood that elastic band 110 is configured to come into direct contact with at least a portion of the outer ears and at least a portion of the back of the head of user 102 forming a full circuit from the upmost point of top edge 106 to the back of head of user 102 in order to provide a snug retention of face shield 100 to user 102. It is also to be understood that elastic band 110 may be provided at various lengths in order to support varying head sizes.

Referring now to FIGS. 2-6, an item of personal protective equipment comprising a face shield 200 donned by user 102 is presented according to a second example embodiment. Face shield 200 comprises a left side 202 and a right side 204. In one embodiment, elastic band 110 is coupled to left side 202 and right side 204 allowing elastic band 110 to extend around the head and secure face shield 200 to the head of user 102. Top edge 106 of planar plastic element 104 further comprises a pair of curves 206 configured to prevent planar plastic element 104 from obstructing the eyes of user 102. It is to be understood that pair of curves 206 may be provided at varying lengths and configurations in order to account for various sized contours. In one embodiment, face shield 200 further comprises a slope 208 configured to allow planar plastic element 104, either alone or in combination with nose bridge 113, to rest on the nose of user 102. In one embodiment, the volume of elastic band 110 positioned directly above pair of curves 206 is significantly less voluminous than the volume of elastic band 110 positioned on the outer ear of user 102. In other words, a minimal or significantly low amount of elastic is allocated along the upmost point of top edge 106 at the middle portion and continues to remain a minimal or significantly low amount at pair of curves 206 up until elastic band 110 passes the eye area of user 102 on the left side 202 and right side 204, in which the volume of elastic increases preventing obstruction of the eyes of user 102.

In one embodiment, opening (or gap) 112 is configured to begin near or below the nose of user 102 allowing space between the remaining portions of planar plastic element 104 (the portions of planar plastic element 104 that are not associated with top edge 106 and other applicable components of planar plastic element 104 that are not in direct contact with the face of user 102) and the face of user 102. In other words, the nose and upper area of the cheeks of user 102 are in direct contact with planar plastic element 104 while the nostrils and everything below the nostrils of user 102 are in direct contact with opening 112. In application, while top edge 106 is aligned with the contours of the face of user 102, opening 112 serves as a protected breathing space that ends at bottom edge 108 aligned at or near the chin of user 102, and the protected breathing space is shielded from viruses/diseases and applicable germs by planar plastic element 104.

Figure 7:
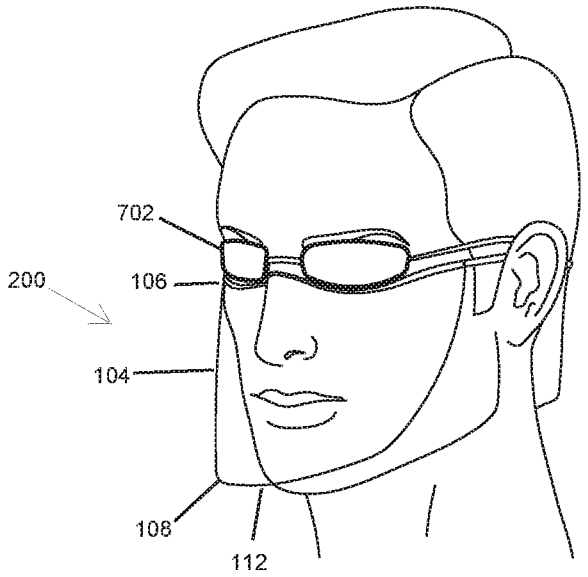
FIG. 7 is a second front perspective view of the item for personal protective equipment comprising a face shield donned by the user positioned below a pair of glasses according to the second example embodiment.

Referring now to FIG. 7, the item of personal protective equipment comprising face shield 200 donned by user 102 who is wearing a pair of goggles or glasses 702 is depicted. As illustrated, face shield 200 is configured to be worn by user 102 in a manner that does not obstruct the eyes allowing pair of glasses to be positioned directly above top edge 106 in a manner that does not cause pinching or grasping of skin between top edge 106 and glasses 702. The temples of glasses 702 are able to comfortably and securely rest atop portions of elastic band 110 allocated at left side 202 and right side 204 of face shield 200. In one embodiment, pair of curves 206 are directly aligned with the lenses of glasses 702 separated by the minimal or significantly low volume of elastic band 110. It is to be understood that face shield 200 is worn in a manner that supports user 102 wearing goggles or glasses 702 and does not have any continuous contact with the frames and/or lenses of glasses 702; thus, avoiding obstruction of the eyes and accessories associated with the eyes of user 102.

Figure 8:
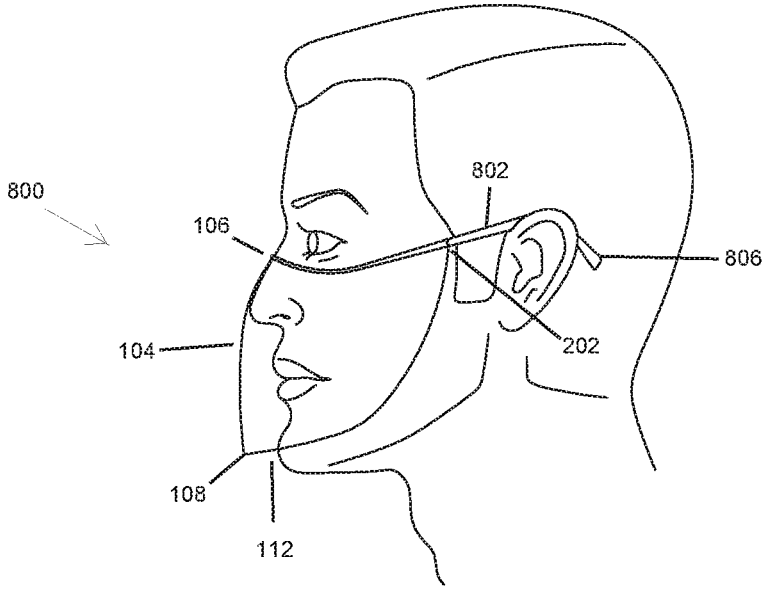
FIG. 8 is a left side view of an item for personal protective equipment comprising the face shield donned by a user, according to a third example embodiment.
Figure 9:
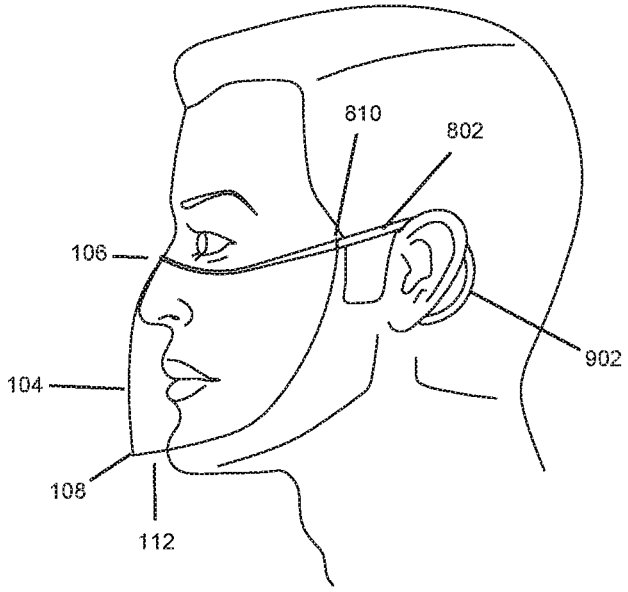
FIG. 9 is a left side view of an item for personal protective equipment comprising the face shield donned by a user, according to a fourth example embodiment.

Referring now to FIGS. 8-9, an item of personal protective equipment comprising a face shield 800 donned by user 102 is presented according to a third and a fourth example embodiment, respectively. In one embodiment, face shield 800 comprises a first temple 802 coupled to left side 202 of planar plastic element 104 and a second temple (not shown) coupled to right side 204 of planar plastic element 104 in which both first and second temple are configured to extend along the left and right side of the face of user 102, respectively. In one embodiment, first temple 802 and second temple are configured to be in direct contact with the top outer ears of user 102 as illustrated in FIG. 8, and are further configured to comprise a left temple end 806 and a right temple end (not shown) that allows securing of face shield 800 to the face. It is to be understood that top edge 106 holds face shield 800 in place on the face of user 102 while left temple end 806 and right temple end securely retains face shield 800 by allowing the weight of face shield 800 to rest atop the outer ear area.

In one embodiment, first temple 802 and second temple further comprise an elongated left temple end 902 and an elongated right temple end (not shown) as illustrated in FIG.

9 in which the left and right elongated temple ends are configured to wrap around the whole back of the ears of user 102 respectively. In one embodiment, first temple 802 and second temple may comprise a core wire configured to increase the retention strength of the temples, the temples may be composed of acetate, metal, durable plastic, or any other applicable material configured to support retention of the temples to the outer ears in a manner that allows face shield 800 to be retained in place on the face user 102. It is to be understood that although first temple 802 and second temple are configured to be allocated on left side 202 and right side 204, the applicable material that the temples are composed of is configured to continuously trace pair of curves 206 and the perimeter of top edge 106 in the same manner that elastic band 110 does for the aforementioned configurations. Thus, user 102 simply has to put the temples on the ears in the same manner that one would with a pair of glasses resulting in left temple end 806 and right temple end or elongated left temple end 902 and elongated right temple end coming into direct contact with the ears of user 102 while top edge 106 is secured to the face.

In one embodiment, first temple 802 and second temple each further comprise a hinge 810 (shown in FIG. 9) such that the temples may rotate about the hinge. When the temples are rotated outwards about the hinge, the temples are oriented for use by the user, and when the temples are rotated inwards about the hinge, the device is oriented for stowing or storing the device.

Figure 10:
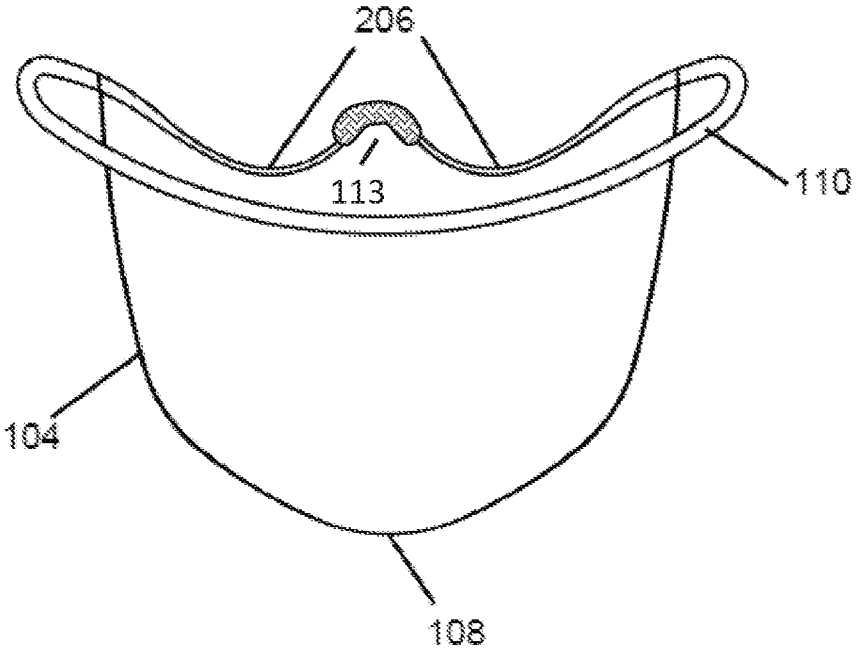
FIG. 10 is a rear view of the item for personal protective equipment comprising a face shield according to a third example embodiment.

FIG. 10 is a rear view of the item for personal protective equipment comprising a face shield according to a third example embodiment. In the embodiment shown in FIG. 10, a nose bridge 113 is configured to be allocated along a middle portion of face shield, wherein the nose bridge 113 comprises one or more seal forming portions and a cushion component in order to provide a more comfortable fitting based on a more stable foundation rooted in the nose area of user 102. The nose bridge 113 may comprise a roughly U-shaped element that rests on the crown of the nose so as to provide a comfortable interface between the device 100 and the user's nose.

Figures 11, 12, 13:
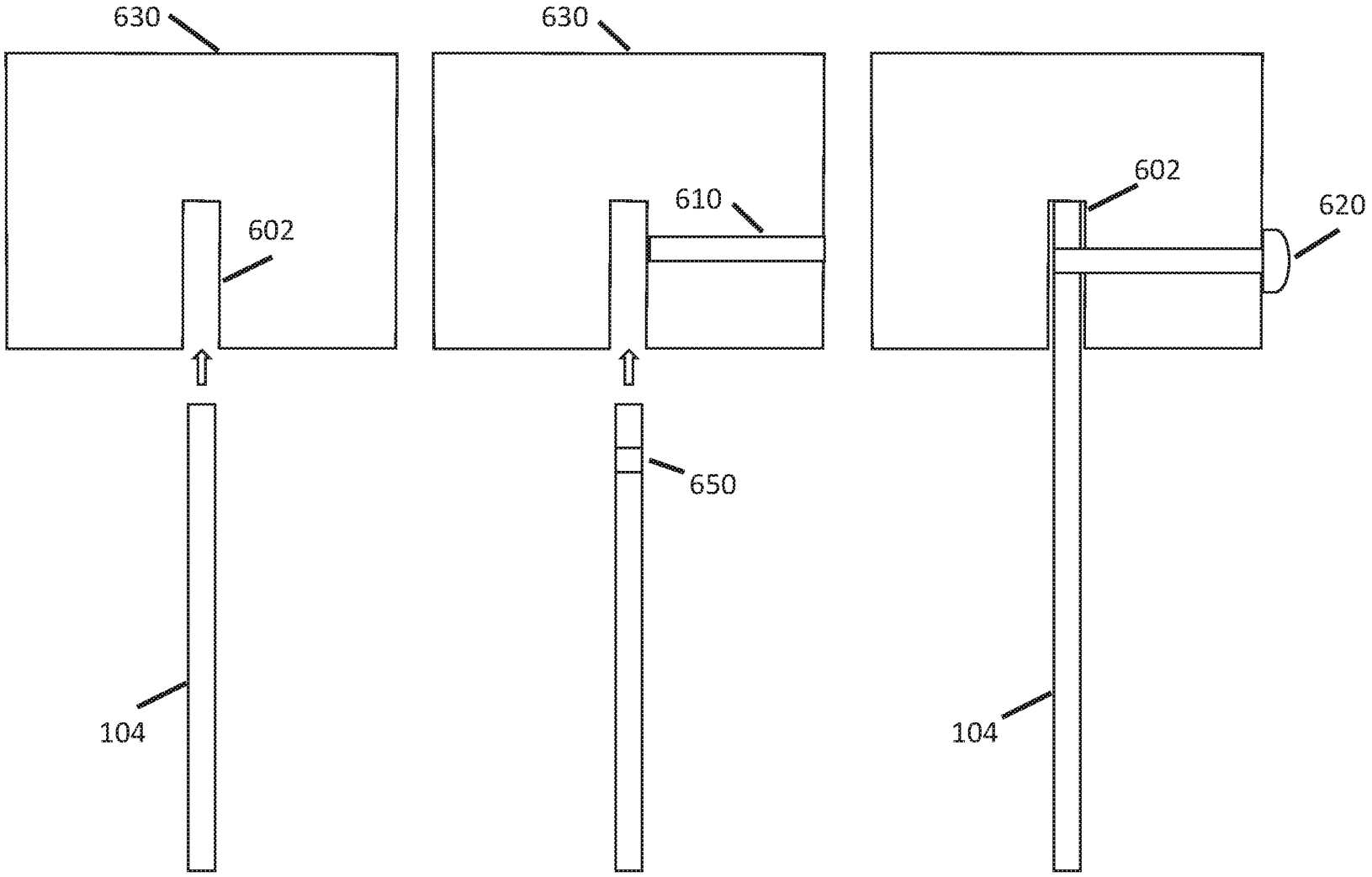
FIG. 11 is a cross-sectional view of a portion of the item for personal protective equipment comprising a face shield, according to an example embodiment.
FIG. 12 is another cross-sectional view of a portion of the item for personal protective equipment comprising a face shield, according to an example embodiment.
FIG. 13 is another cross-sectional view of a portion of the item for personal protective equipment comprising a face shield, according to an example embodiment

FIG. 11 is a cross-sectional view of a portion of the item for personal protective equipment comprising a face shield, according to an example embodiment. In one alternative embodiment, the top edge 106 comprises a rigid plastic frame 630 that extends from the left side 202 of the device to the right side 20. FIG. 11 shows a cross section of the rigid plastic frame 120, which includes a groove 602 that runs along a longitudinal axis of the rigid plastic frame 120. The groove 602 is configured to accept the thickness and shape of the planar plastic element 104 such that when the top edge of the planar plastic element 104 is inserted into the groove 602, a friction fit is achieved and the top edge of the planar plastic element 104 is held firmly within the groove 602. FIG. 12 shows an embodiment wherein rigid plastic frame 120 may include a horizontal orifice 610 that extends from the outer surface of the frame to the grove 603. Likewise, FIG. 12 shows that the top edge of the planar plastic element 104 include an orifice 650. FIG. 13 shows an embodiment wherein the planar plastic element 104 has been inserted into the groove 602 and a dowel 620, screw, pin or other fastener has been inserted through the orifice 620 and through the orifice 650, such that planar plastic element 104 is held firmly within the groove 602. The orifices 610 and 650 may be configured to accept the thickness and shape of the dowel 620, screw, pin or other fastener such that when the dowel 650 is inserted into the orifices 610, 650, a friction fit is achieved and the dowel is held firmly within the orifices, which, in turn, holds the plastic element firmly within the groove 602.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

I claim:

1. An item of personal protective equipment comprising:

a face shield comprised of a curved plastic element that is transparent, wherein the curved plastic element is configured to fit over a person's face, wherein a top edge of the curved plastic element is configured to match contours of the person's face below the person's eyes, and wherein a bottom of edge the curved plastic element is configured to extend at least to the person's chin;

a portion of plastic coupled to the top edge of the curved plastic element such that the portion of plastic is configured to contact the person's face below the person's eyes, wherein the portion of plastic is less voluminous at a midpoint that is configured to contact a bridge of the person's nose, and wherein the portion of plastic is more voluminous as the portion of plastic extends outwards from the midpoint; and an elastic band coupled to a left side and a right side of the curved plastic element, wherein the elastic band is configured to extend around the person's head and to secure the face shield to the person's face.

2. The item of claim 1, wherein the curved plastic element is composed of polycarbonate.

3. The item of claim 1 further comprising a nose bridge configured to securely fit the curved plastic element to the contours of the person's face below the person's eyes.

4. The item of claim 3, wherein the nose bridge is allocated at a middle portion of the top edge of the curved plastic element.

5. The item of claim 1, wherein the elastic band is configured to contact an outer ear of the person.

6. The item of claim 1, wherein the top edge of the curved plastic element includes a pair of curves configured to avoid obstructing the person's eyes with the curved plastic element.

7. The item of claim 1, wherein an upper most margin of the curved plastic element includes a slope such that the curved plastic element rests on the person's nose.

8. An item of personal protective equipment comprising:

a face shield comprised of a curved plastic element that is transparent, wherein the curved plastic element is configured to extend from below a person's eyes to at least the person's chin, wherein a top edge of the curved plastic element is configured to match contours of the person's face below the person's eyes;

a portion of plastic coupled to the top edge of the curved plastic element such that the portion of plastic configured to contact the person's face below the person's eyes, wherein the portion of plastic is less voluminous at a midpoint that is configured to contact a bridge of the person's nose, and wherein the portion of plastic is more voluminous as the portion of plastic extends outwards from the midpoint; and an elastic band coupled to a left side and a right side of the curved plastic element, wherein the elastic band is configured to extend around the person's head and to secure the face shield to the person's face.

9. The item of claim 8, wherein the curved plastic element is composed of polycarbonate.

10. The item of claim 8 further comprising a nose bridge configured to securely fit the curved plastic element to the contours of the person's face below the person's eyes.

11. The item of claim 10, wherein the nose bridge is allocated at a middle portion of the top edge of the curved plastic element.

12. The item of claim 8, wherein the elastic band is configured to contact an outer ear of the person.

13. The item of claim 8, wherein the top edge of the curved plastic element includes a pair of curves configured to avoid obstructing the person's eyes with the curved plastic element.

14. The item of claim 8, wherein an upper most margin of the curved plastic element includes a slope such that the curved plastic element rests on the person's nose.

15. An item of personal protective equipment comprising:

a face shield comprised of a curved plastic element that is transparent, wherein the curved plastic element is configured to extend from below a person's eyes to at least the person's chin, wherein a top edge of the curved plastic element is configured to match contours of the person's face below the person's eyes, and wherein a bottom edge of the curved plastic element is configured to provide a gap between the curved plastic element and the person's chin;

a rigid plastic frame coupled to the top edge of the curved plastic element, wherein the rigid plastic frame is configured to match contours of the person's face below the person's eyes, such that the rigid plastic frame contacts the person's face continuously from a left side of the person's face, below a left eye, over the person's nose, and to a right side of the person's face, below a right eye, wherein plastic frame is less voluminous at a midpoint that is configured to contact a bridge of the person's nose, and wherein the plastic frame is more voluminous as the plastic frame extends outwards from the midpoint; and a first temple coupled to a left side of the rigid plastic frame and a second temple coupled to a right side of the rigid plastic frame, wherein the first and second temples are configured to secure the face shield to the person's face.

16. The item of claim 15, wherein the curved plastic element is composed of polycarbonate.

17. The item of claim 15 further comprising a nose bridge configured to securely fit the curved plastic element to the contours of the person's face below the person's eyes.

18. The item of claim 17, wherein the nose bridge is allocated at a middle portion of the top edge of the curved plastic element.

19. The item of claim 15, wherein the top edge of the curved plastic element includes a pair of curves configured to avoid obstructing the person's eyes with the curved plastic element.

20. The item of claim 15, wherein an upper most margin of the curved plastic element includes a slope such that the curved plastic element rests on the person's nose.

* * * * *